US005400530A

United States Patent [19]

Schmidt

[11] Patent Number: 5,400,530

[45] Date of Patent: Mar. 28, 1995

[54] DRAGLINE EXCAVATOR BUCKET AND RIGGING

[76] Inventor: Don F. Schmidt, 624 Birchwood Dr., Bismarck, N. Dak. 58504

[21] Appl. No.: 931,781

[22] Filed: Aug. 18, 1992

Related U.S. Application Data

[63] Continuation-in-part of Ser. No. 739,192, Aug. 1, 1991, abandoned.

[51] Int. Cl.[6] ..... E02F 3/46

[52] U.S. Cl. ..... 37/399; 37/396; 37/401

[58] Field of Search ..... 37/396, 399, 398, 401, 37/395, 394, 444, 446, 448

[56] References Cited

U.S. PATENT DOCUMENTS

| | | | |
|---|---|---|---|
| 887,990 | 5/1908 | Weeks . | |
| 946,899 | 1/1910 | Hayward . | |
| 1,147,432 | 7/1915 | Potter . | |
| 1,183,750 | 5/1916 | Mitchell . | |
| 1,242,320 | 10/1917 | Burkett . | |
| 1,512,936 | 10/1924 | Knapp . | |
| 1,714,120 | 5/1929 | Bailey, Jr. . | |
| 1,732,942 | 10/1929 | Martinson et al. | 37/399 X |
| 2,096,773 | 10/1937 | Weimer . | |
| 2,145,904 | 2/1939 | Weimer . | |
| 2,200,315 | 5/1940 | Weimer . | |
| 2,249,070 | 7/1941 | Weimer . | |
| 2,334,460 | 11/1943 | Weimer . | |
| 2,629,190 | 2/1953 | Berner | 37/396 |
| 2,669,042 | 2/1954 | Swank . | |
| 3,112,572 | 12/1963 | Larsen | 37/399 |
| 3,541,710 | 11/1970 | Sankey et al. | 37/396 |
| 3,597,865 | 8/1971 | Rumfelt | 37/396 |
| 4,238,896 | 12/1980 | Lanz et al. . | |
| 4,601,119 | 7/1986 | Klett | 37/448 |
| 4,791,738 | 12/1988 | Briscoe | 37/399 |
| 4,864,747 | 9/1989 | Martin et al. | 37/399 |
| 4,944,102 | 7/1990 | Behlendorf et al. | 37/398 X |

*Primary Examiner*—Randolph A. Reese
*Assistant Examiner*—Spencer Warnick
*Attorney, Agent, or Firm*—Westman, Champlin & Kelly

[57] ABSTRACT

A dragline excavating bucket is constructed to be supported through a minimum number of support chains and control cables, and made to provide for rapid digging and distribution of overburden removed by dumping the bucket rearwardly over a rear wall of the bucket. The bucket is supported on hoist chains that are located forwardly of the center of gravity so the bucket tends to tip rearwardly. The tilted portion of the bucket is controlled through a pair of drag chains that not only provide the pull force for loading the bucket, but also control the dumping of material from the bucket over the rear wall. Sliding trunnions are used on the bucket pivots to enhance dumping operation.

12 Claims, 9 Drawing Sheets

DRAGLINE EXCAVATOR BUCKET AND RIGGING

CROSS REFERENCE

This application is a Continuation-In-Part of my application Ser. No. 07/739,192,filed on Aug. 1, 1991, now abandoned, for DRAGLINE EXCAVATOR BUCKET AND RIGGING.

BACKGROUND OF THE INVENTION

The present invention relates to a dragline bucket for large excavating draglines, which is supported by a pair of hoist chains mounted toward the front from the center of gravity of the bucket, so that the bucket dumps over its rear wall under control of drag chains and cables.

Prior art dragline buckets are extremely heavy, rugged buckets that have front teeth for digging and which are supported on a pair of hoist chains located toward the rear of the bucket. The buckets are filled by pulling the bucket with drag chains. The material in the bucket is dumped over the front teeth using a dumping system consisting of dump cable sheave or sheaves, dump rigging cables and attachments. The bucket construction generally requires some type of a spreader bar or high arch at the front of the bucket, and a number of cables, sheaves and dump rigging components for controlling the bucket material during the swing and dumping cycle. Dumping out the front end drops the material in a direction toward the dragline power unit, thereby minimizing the available space in which the overburden material can be piled, because the length of the supporting boom for a dragline is necessarily limited due to load, size and weight considerations.

A lighter weight dragline bucket that utilizes a somewhat lower rear wall than most standard buckets is shown in U.S. Pat. No. 4,944,102. U.S. Pat. No. 4,944,102 has the hoist chains mounted near the rear of the bucket but on the inside. This placement of the hoist chain necessitates having strong or reinforced sidewalls on the bucket and also a cross bar is used on the front end of the bucket for strength purposes. The bucket is dumped out the front and is controlled through the use of dump ropes or cables attached to the drag chains, requiring a set of sheaves and other rigging component parts that increases costs and maintenance. The present invention eliminates many of the problems by lightening the bucket, and reducing the number of component parts needed, which results in a lighter weight, more efficient and lower cost operating bucket and rigging system.

SUMMARY OF THE INVENTION

A dragline bucket is rigged with hoist chains positioned near the front of the bucket and with drag chains which control the filling portion, as well as the dumping of the bucket. The bucket is made to dump over its rear wall upon slackening of the drag chains while the bucket pivots in the rearward direction on trunnions attached to the bucket sidewalls and which support the hoist chains.

The hoist chains are positioned toward the front of the bucket and between the loaded bucket center of gravity and the front teeth or bucket lip, and are mounted onto heavy duty cheek plates that support the teeth, as well as the connection points for the drag hitch, including drag chains and drag cables. The cheek plates provide an attachment location for the hoist chain trunnions. The cheek plates also have connections for the drag pull chains near the forward edge of the bucket, above and forwardly of the attachment trunnions for the hoist chains.

The hoist chains will pivot about their attachment points to the bucket.

The preferred embodiment of the invention has sliding hoist trunnion pins for permitting the effective pivot axis of the hoist chains to shift more toward the front of the bucket and thus ensures complete dumping. In the loading positions the pivot of the bucket is shifted rearwardly for more equalization of the loads which means better balance, thus requiring less tension on the draglines to maintain bucket position during the hoisting of a loaded bucket. This also reduces the tightlining of the hoist and drag lines and thus reduces stresses to the boom.

The bucket is filled in a normal manner as the drag chains pull the bucket forwardly, and then when hoisted, the bucket will tend to tip rearwardly. The rearward tipping is controlled by maintaining a tension on the drag chains to provide for a force that resists the rearward pivoting of the bucket and prevents dumping. Moving the trunnion pins rearwardly during loading, hoisting and swing cycles of the bucket reduces the power required to control the operation of the bucket. The improved operation means substantial savings in both time and cost.

As the boom, hoist chains, bucket and drag chains of the dragline power unit are swung to the discharge area, the drag chains are slackened, and the bucket tilts rearwardly to discharge the material in the bucket out the back of the bucket. This tends to throw the material radially out farther from the power unit than with conventional front dump buckets. This means that more material can be distributed at a given area, allowing the dragline power unit to excavate at a greater depth and in a wider excavating pit using the same length of boom, This provides a more efficient removal of material than prior art dragline buckets. Again, in the preferred embodiment the trunnions shift more forwardly during dumping to speed the dumping operation.

The loading of the bucket is not impaired by the location of the hoist chains. The present device eliminates need for a heavy arch on the front of the bucket, because the bucket is supported near its front edge, as opposed to its rear edge, as well as eliminating hoist chain spreader bars, lower hoist chains, dump block sheaves, dump cables, and rigging and bucket dump attachments that are used on standard drag line bucket systems. The present bucket has no spreader bar between the cheek plates as shown, but includes suitable reinforcing for the bucket sidewalls, as well as the bottom and rear walls. The cheek plates and digging teeth mounts are formed as a heavy single unit. The heavy cheek plates support all of the cables used in the rigging, namely the hoist cables near the rear of the cheek plates and the drag chain pull hitch at the forward edge of the cheek plates. In extremely large buckets using the present design, for example, 100 cubic yards and larger, a top cross bar may be used for reinforcement.

The upper edge of the rear wall can be reinforced with a heavy duty pipe that serves as a bumper and strengthener for the bucket, but which is out of the area where material will fill.

The bucket of the present invention obtains its weight savings through the reduction of wall thickness and reinforcing from areas not essential to bucket strength and wear, which can be done when the hoist chains are moved forwardly. This allows for more working or payload capacity for a dragline bucket, without exceeding the maximum allowable load on the dragline boom., as well as reducing the cycle time between loading and dumping, and the maintenance costs.

The rear dumping permits discharging of the overburden payload at a higher height, and farther from the drag line power unit.

The dragline teeth at the front lip of the bucket are positioned along a rounded edge. The center teeth extend forwardly or outwardly farther than the teeth near the sides of the bucket to allow the excavating teeth to penetrate into the material to be excavated with less effort and for a faster filling bucket using less power. Also, because the center teeth protrude outwardly farther than the rest, a more efficient downchopping mode, that is when the bucket is empty and permitted to freefall into the overburden being removed, is obtained due to the teeth placement and concentrating the weight of the bucket adjacent the forward end.

The bucket has a three-way tapered basket. The sidewalls taper outwardly in upward direction from the floor and also diverge from the front to the rear of the basket. The rear wall slopes rearwardly and upwardly from the floor, rather than extending straight up, to create a full length basket for the overburden material to flow outwardly when it is being dumped out the rear wall.

The top edges of the sidewalls are constructed to be parallel to the floor for a major portion of the length of the floor, and then the top edges of the sidewalls slope downwardly to meet the top edge of the upwardly and rearwardly sloping rear wall.

The bucket can easily be adapted for either one, two or four hoist line excavating draglines.

DETAILED DESCRIPTION OF THE PREFERRED EMBODIMENTS

Figure 1:
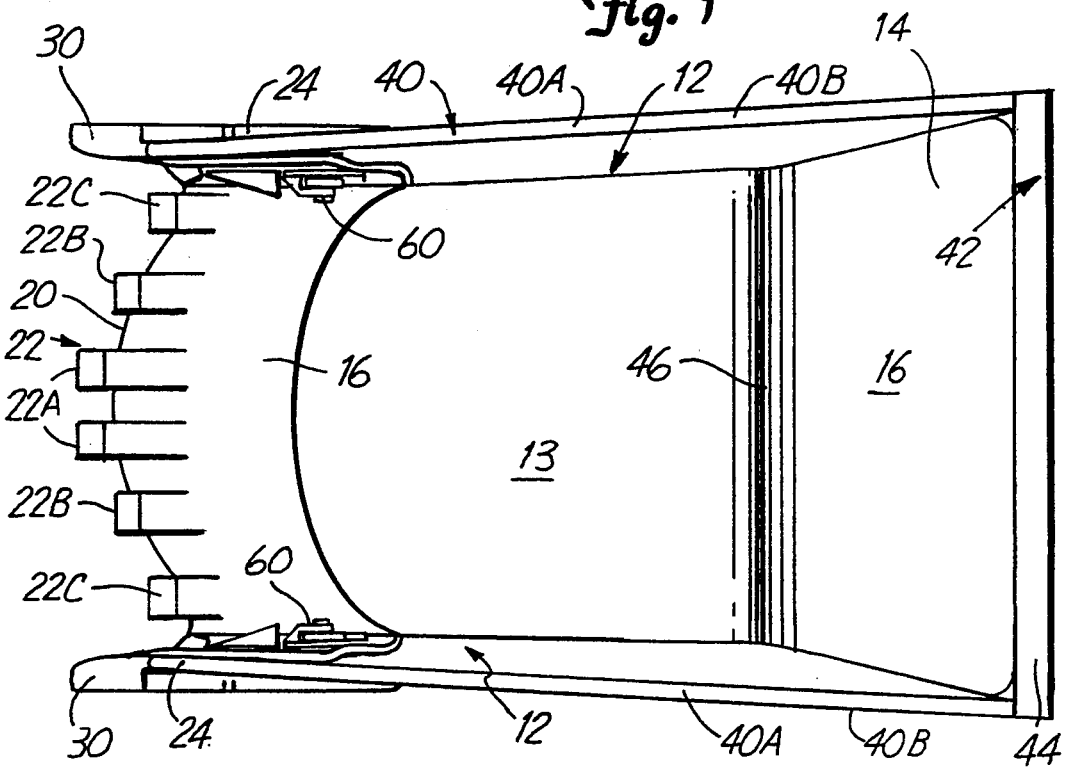
FIG. 1 is a top plan view of a drag line bucket made according to the present invention.

A dragline bucket indicated generally at 10 includes two spaced, upright sidewalls 12, joined to a floor 13 and also joined to an upwardly sloping rear wall 14. The rear wall 14 joins and slopes upwardly from the bottom wall or floor and is at an opposite end of the bucket 10 from a front lip plate assembly 16 which is used for supporting digging teeth. As shown, the lip plate assembly 16 is of heavy material that is welded to the floor 13, and it has a generally rounded front edge 20 which supports excavating teeth shown generally at 22. The teeth 22 are spaced apart along this rounded edge. The two teeth 22A in the center portions protrude forwardly farther than the teeth 22B along the sides of the center teeth or the outer side teeth 22C, which are positioned the farthest rearwardly.

Figure 2:
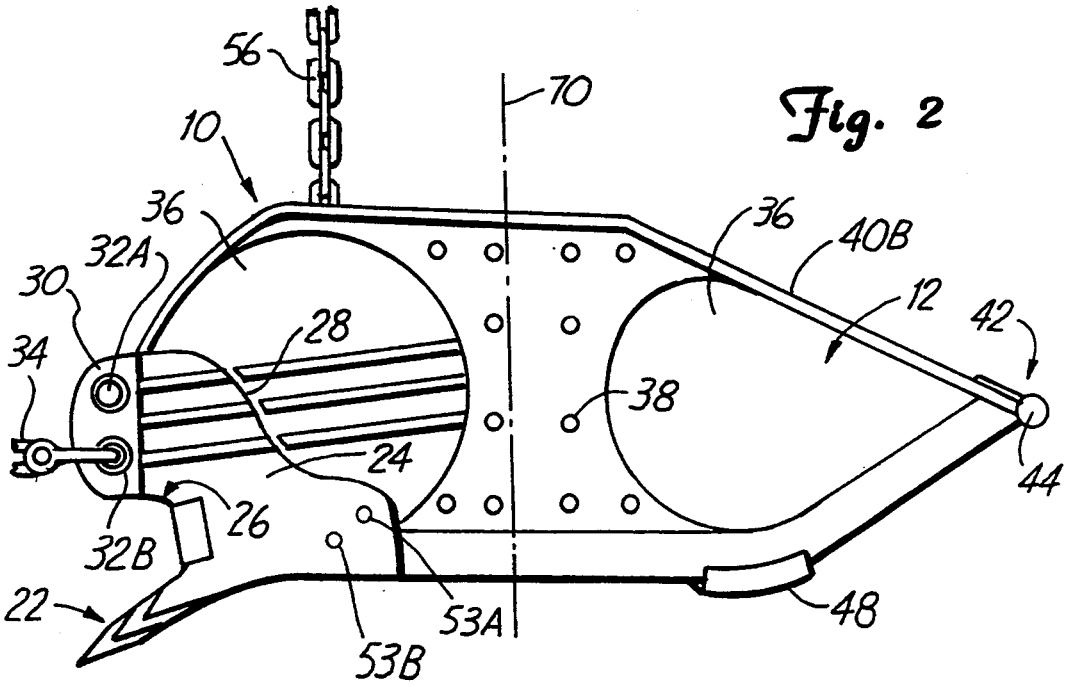
FIG. 2 is a side elevational view of the dragline bucket of FIG. 1.
Figure 3:
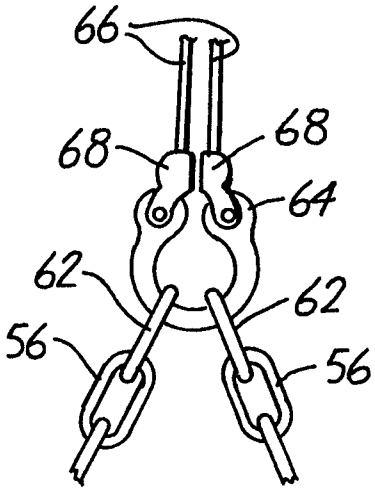
FIG. 3 is an enlarged view of a hoist equalizer utilizing the arrangements for connecting the hoist chains to the present invention.

The lip plate assembly 16 has a heavy plate extending across the bucket and has integrally attached upright cheek plates 24 along opposite sides thereof, which are welded in place as desired, and which have a substantial thickness to provide for a very rigid forward portion of the bucket consisting of the lip plate and the cheek plates 24. The sidewalls 12 are welded to the cheek plates and extend rearwardly from the cheek plates. The cheek plates 24 are contoured or recessed as shown at 26 along the forward edge. As can be seen in FIG. 2, the forward part of lip plate assembly 16 extends downwardly at an angle relative to the floor 13, as shown in FIG. 2, and the downward angle of extension of the teeth 22 enhances the digging and filling of the bucket. The staggering of the teeth along the front curved edge 20 also enhances the digging into the earth and filling of the bucket.

Figure 5:
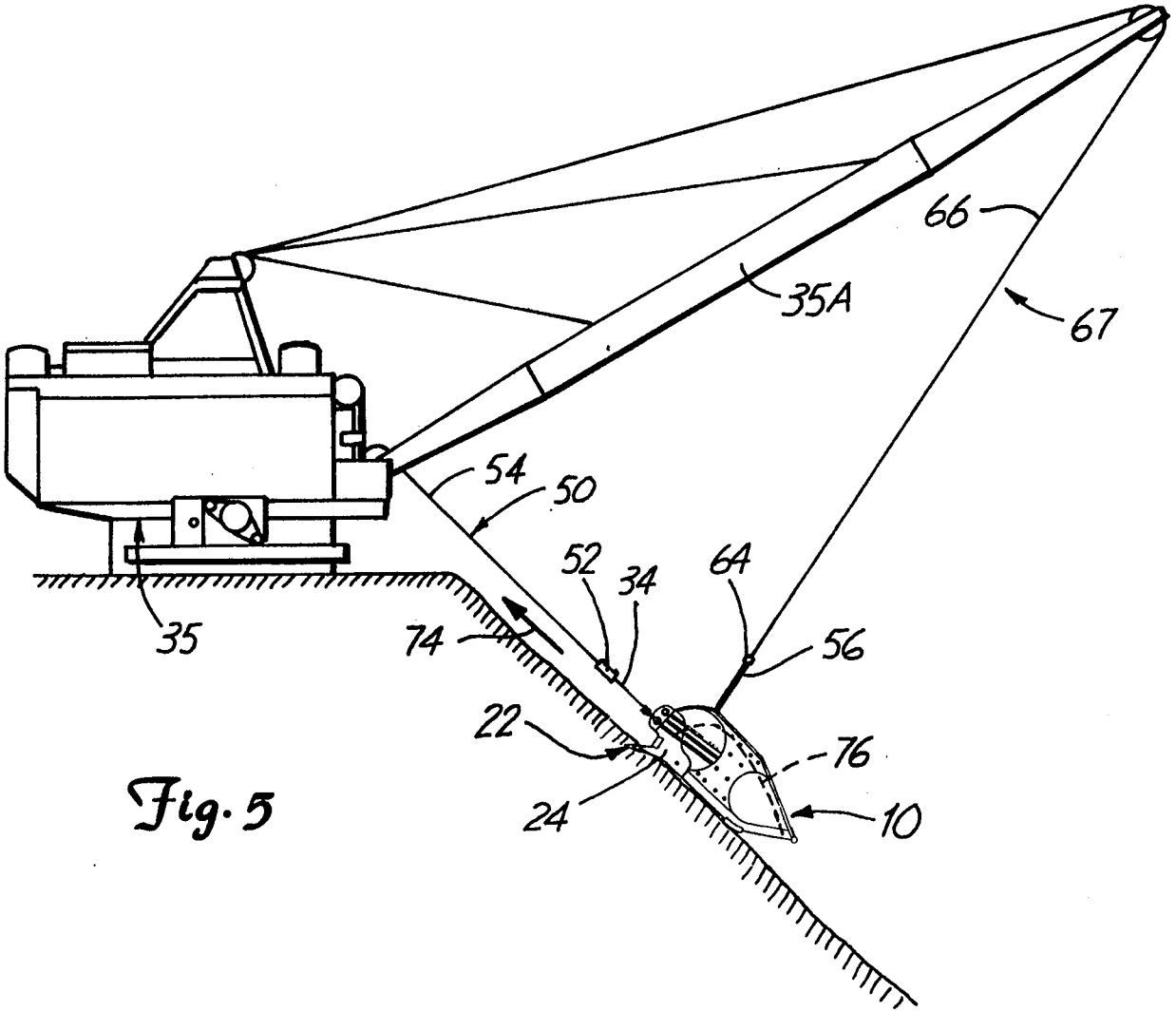
FIG. 5 is a schematic side elevational view of a bucket of the present invention and showing it being loaded.
Figure 4:
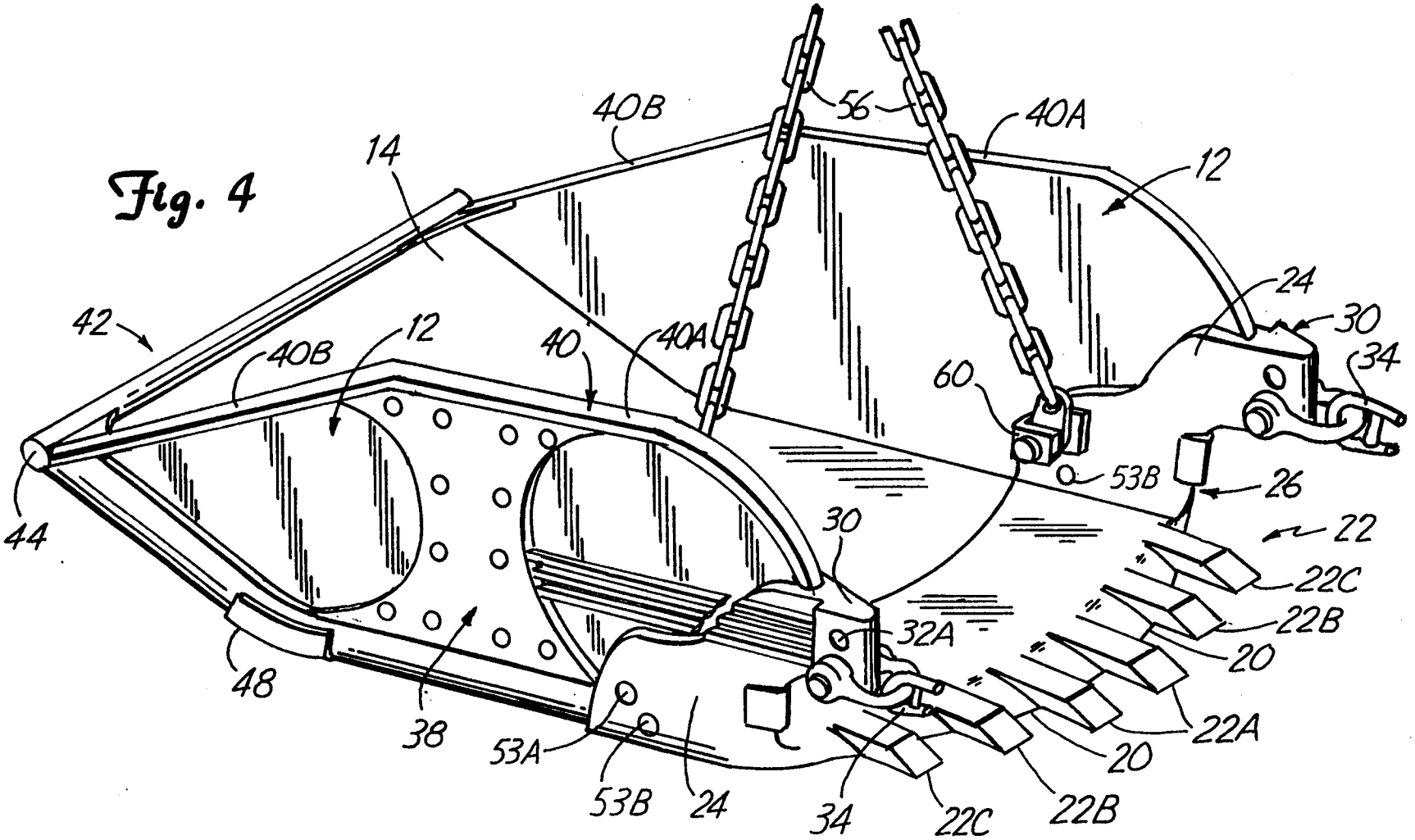
FIG. 4 is a perspective view taken of the dragline bucket of the present invention.

The cheek plates 24 also have contoured, downwardly sloping rear edges shown at 28. The cheek plates 24 are very thick and heavy duty, and have drag link pull hitch members 30 at the forward edges near the upper part of the plates. There are two vertically spaced openings, 32A and 32B, for connecting drag chains 34 on each of the cheek plates. The drag chains are connected to the selected openings through suitable connecting clevises or links. The drag chains, in turn, are connected to rope or cable in a conventional manner with cable termination sockets and operated from the dragline power unit, as shown in FIG. 5 at 35 generally.

The sidewalls 12 each include a first inner plate 36 and an outer reinforcing plate 38 that is welded to the inner plate at spaced spots. The inner plate and reinforcing plate are welded to the floor 13 in a desired manner. The reinforcing plate 38 is cut away in certain portions of its edges for reducing weight. A top rail 40 is provided along the top of each of the sidewalls 12. The top rail 40 has a section 40A that is parallel to the bottom wall 13, and then the sidewalls and the top rail taper down as at 40B toward the upper edge 42 of the rear wall 14. The rear wall 14, likewise, is heavy duty and a very heavy duty shaft 44 is welded across the top edge of the rear wall to provide not only lateral stiffness, but also to provide a bump rail for the bucket.

The rear wall 14 attaches to the floor 13 in the region indicated at 46 and then tapers upwardly and rearwardly. Suitable wear plates 48 can also be provided as desired at the junction of the rear wall 14 and the sidewalls 12.

The rear wall 14 is a low rear wall, and extends only about one-half the distance measured from the plane of the floor 13 to the upper rail section 40A, which is parallel to the bottom wall.

Again, the bucket is wider at the top rails 40A, than it is at the floor 13, and is also wider at the rear end at edge 42 and region 46 than it is at the front. Thus, there is a compound taper of the sidewalls 12 and a taper or slope of the rear wall.

The drag chains 34 are pivotally mounted to the drag chain pull hitch connectors 30, utilizing suitable pins and pull links. The outer ends of the drag chains 34 are connected with suitable cable termination sockets 52 to a length of wire rope or cable 54 that leads to a drum on the power unit 35. The combined chain and cables will be termed "lines", meaning any flexible member suitable for loading. The dragline 50 comprises cables 54 and dragchains 34.

The selection of the openings 32A or 32B in which the drag chains are pinned will depend on the load that is to be lifted with the bucket, and other geometrical configurations.

The bucket 10 is hoisted through the use of only one pair of hoist chains, indicated generally at 56 that go to the respective sides of the bucket. The hoist chains 56 are connected with suitable trunnions 60 to the inside of the cheek plates 24. The trunnions 60 have pins used to hold connecting links of the hoist chains to pivot about the axes of the pins as the bucket 10 tilts. The upper ends of the hoist chains 56 are connected through a pair of pear links 62, which then fit onto a hoist equalizer link 64 that is connected to suitable hoist: wire ropes or cables 66 through cable termination sockets 68. The hoist chains 56 and hoist cables 66 together form hoist lines 67. There are no other pulley mountings, pulleys, spreader bars or the like needed with the present bucket and the hoist equalizer connection.

The hoist chain or hoist line connection openings 53A and 53B on each cheek plate 24 are ahead of a plane perpendicular to the floor 13 and passing through the bucket center of gravity. This plane is indicated at 70 for purposes of illustration. The plane 70 is not intended to show the exact location of the center of gravity, but is used for illustrative purposes.

The bucket 10, when suspended from hoist chains in either one of the openings 53A or 53B, will tilt rearwardly under gravity. That is, the rear wall 14 and rear edge 42 will tend to drop, if no restraining forces are present. However, it can also be seen that tension on the drag chains in either one of the drag chain connection openings 32A or 32B will tend to provide a countering force or moment retaining the bucket in position against the force of gravity.

This means that the rear dumping, as well as the loading and lifting positions of the bucket can be controlled using the hoist lines for vertical position, and tension on the drag lines connected to the drag pull hitch openings 32A or 32B. The hoist cables 66 are connected to a drag line hoist cable drum on the power unit 35, and the hoist chains 56 are pivotally mounted to the trunnions 60 that have pins passing through one set of the openings 53A or 53B on each cheek plate.

Thus, it can be seen that the arrangement of supporting and controlling the bucket, which requires only the drag lines and hoist lines, eliminates a large number of component parts such as an arch on the bucket, a hoist chain spreader bar, lower hoist chains, dumping system rigging, and the sheaves used for the dump blocks. This saves weight, cost, and does not compromise operation. In fact, the present invention shows a bucket and rigging that is more stable in operation than the standard drag-like bucket system due to less component parts. The bucket is compatible to all types and sizes of dragline excavating operations. In extremely high volume buckets, a spreader bar or rod may be used between the sidewalls for additional reinforcement. The spreader bar would be positioned so that it does not interfere with rear dumping, or with the operation of downchopping.

The step of filling a bucket is shown in FIG. 5, wherein the draglines 50 (comprising drag chains 34 and drag cables 54) would be tensioned to tilt the bucket 10 forward as the rear edge 42 of the bucket touches the ground in its digging position. The hoist lines 67 would be kept at a desired length to provide for a proper angle to the teeth 22. The bucket 10 is then pulled upwardly by the drag lines 50 by the power unit 35, as shown by the arrow 74, and filled to the desired level. The bucket 10 is filled with overburden illustrated in dotted lines at 76 in FIG. 5 and then the bucket 10 is put into a hoisting and swinging cycle by the power unit 35.

Figure 6:
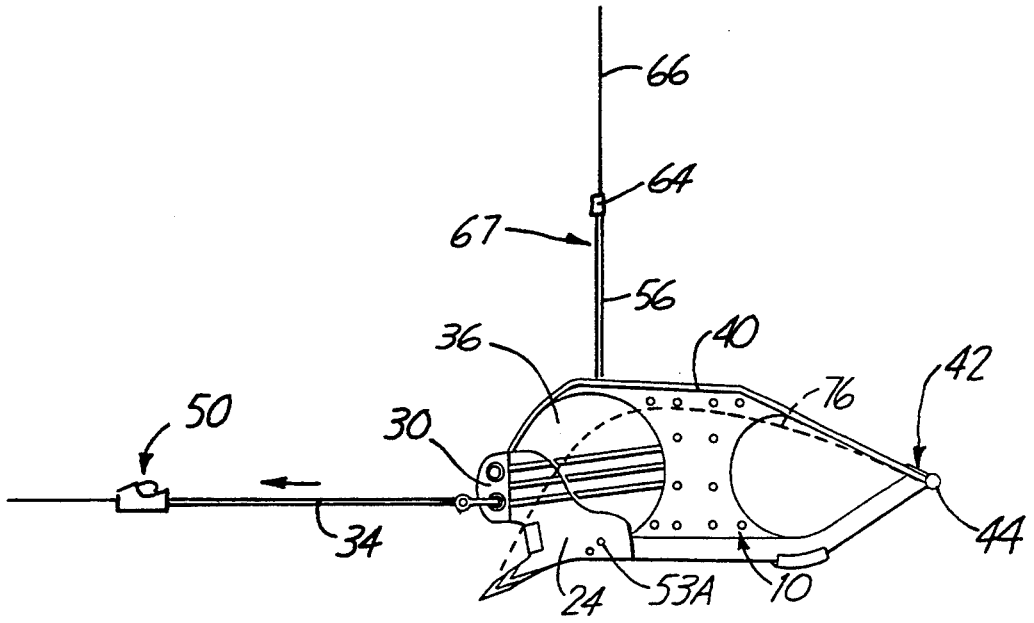
FIG. 6 is a view of the bucket of the present invention during the hoisting operation.

At the start of the hoist cycle, the hoist chains 56 are tightened by running the drum from the power unit 35 to tighten and reeve in the hoist cables 66. This puts a lifting force through the hoist lines on the end links of the hoist chains at one set of openings 53A or 53B. The loaded bucket is lifted while the drag lines 50 exert a holding force to the drag pull hitches 32 providing a moment tending to keep the bucket in a substantially level position, as shown in FIG. 6, as it is hoisted. The swing of the boom 35A will be started as the bucket clears the excavation until the bucket is swung to a position approaching the dump site.

Figure 7:
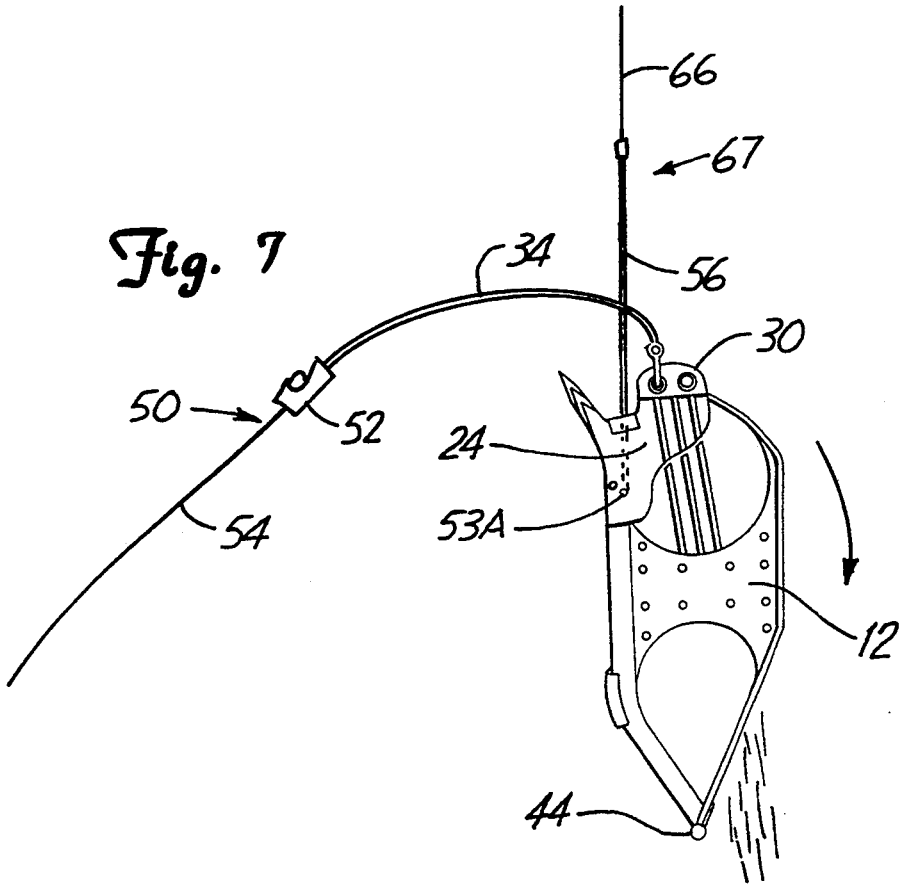
FIG. 7 is a view of the bucket of the present invention being dumped.

As this occurs, the drag lines 50 are payed out of the drag drum under control of the operator, and because of the positioning of the attachment point of the hoist lines 67, the bucket will tilt and dump rearwardly, as shown in FIG. 7, causing the material to flow out along the rear wall and out over the edge 42 and the shaft 44. The hoist chains 56 are pivotally mounted at the hoist trunnions 60 near the forward end and to the inside of the sidewalls 12. The paying out of the drag lines 50 allows the bucket to tip back and discharge the overburden in a direction away from the dragline power unit 35, with the inertia of the material tending it to carry it away from the power unit. This makes dumping possible at a greater height and further distance away from the power unit than front dump buckets when using the same length boom 35A.

After the completion of the dumping cycle, as shown in FIG. 7, the bucket 10 is brought back to the start of the next digging cycle by releasing tension of the hoist lines 67 and lowering the bucket 10 until its rear edge 42 touches the ground and then tightening the drag lines 50 which will tilt the bucket 10 forward to the desired position and the filling cycle will repeat. Due to the taper of the bucket sidewalls 12 outwardly from the floor to the upper edges, and the widening taper of the bucket from front to the rear, an undisturbed flow through the overburden material will occur and will allow the bucket to be filled with overburden in a shorter cycle using less power than a standard dragline bucket system which has the back wall at the same height as the sidewalls and is at right angles to the floor.

The bucket lip plate assembly 16 mounting the adapters for the excavator teeth 22, which excavator teeth can be pinned into the adapters that are integral with the lip 16, provide for ease of filling. Lip shrouds are provided at the unprotected area of the lips to reduce wear on the leading edge of the lip, and cheek shrouds can be used along the forward leading edges of the cheeks to reduce wear.

Since the bucket is lifted near the front opening, and the hoist chains which carry substantial load are attached to heavy cheek plates, the rest of the sidewalls can be made of a lighter material than in prior buckets.

The construction of the bucket and rigging makes for a very high production bucket, not only because of lighter empty weight, but also due to the smooth rapid dumping that is possible with rear discharge, as shown.

The slope of the rear wall is gentle, for example about 30° up from the plane of the floor to the outer surface of the rear wall.

FIG. 8 through FIG. 13 show a modified dragline bucket 110 with a sliding trunnion arrangement for supporting the hoist chains and modified excavating teeth. The numbers used to identify the elements in the alternate embodiments are differentials of one hundred for similar elements. The lip plate assembly 116 has a generally rounded front edge 120 which supports the excavating teeth shown generally at 122. This rounded front edge 120 uniquely decreases the power and time needed to fill the bucket 110. Further, the rounded front edge 120, the planar excavating teeth 122 and the cutting edge 151 on excavating teeth 122 are not tilted down excessively, so deep grooves are not left after the bucket is filled. This reduces a need to clean up and smooth dragged areas with a blade or bulldozer after excavation. The edge 151 on each tooth is slightly below the plane of the bucket floor, where this ridge was created by sloped cut 153 on the ends of the planar excavating teeth 122. The sloped cut 153 begins on the top side 157 of the planar excavating teeth 122, and the cut slopes downwardly and outwardly away from the bucket body toward the bottom ridge or edge 151 of the excavating teeth 122.

The excavating teeth 122 are spaced apart along this rounded edge 120 thereby creating crevices 155. The two teeth 122A in the center portions protrude forwardly farther than the intermediate teeth 122B which are along the sides of the center teeth or the outer side teeth 122C, which are positioned the farthest rearwardly.

Figure 8:
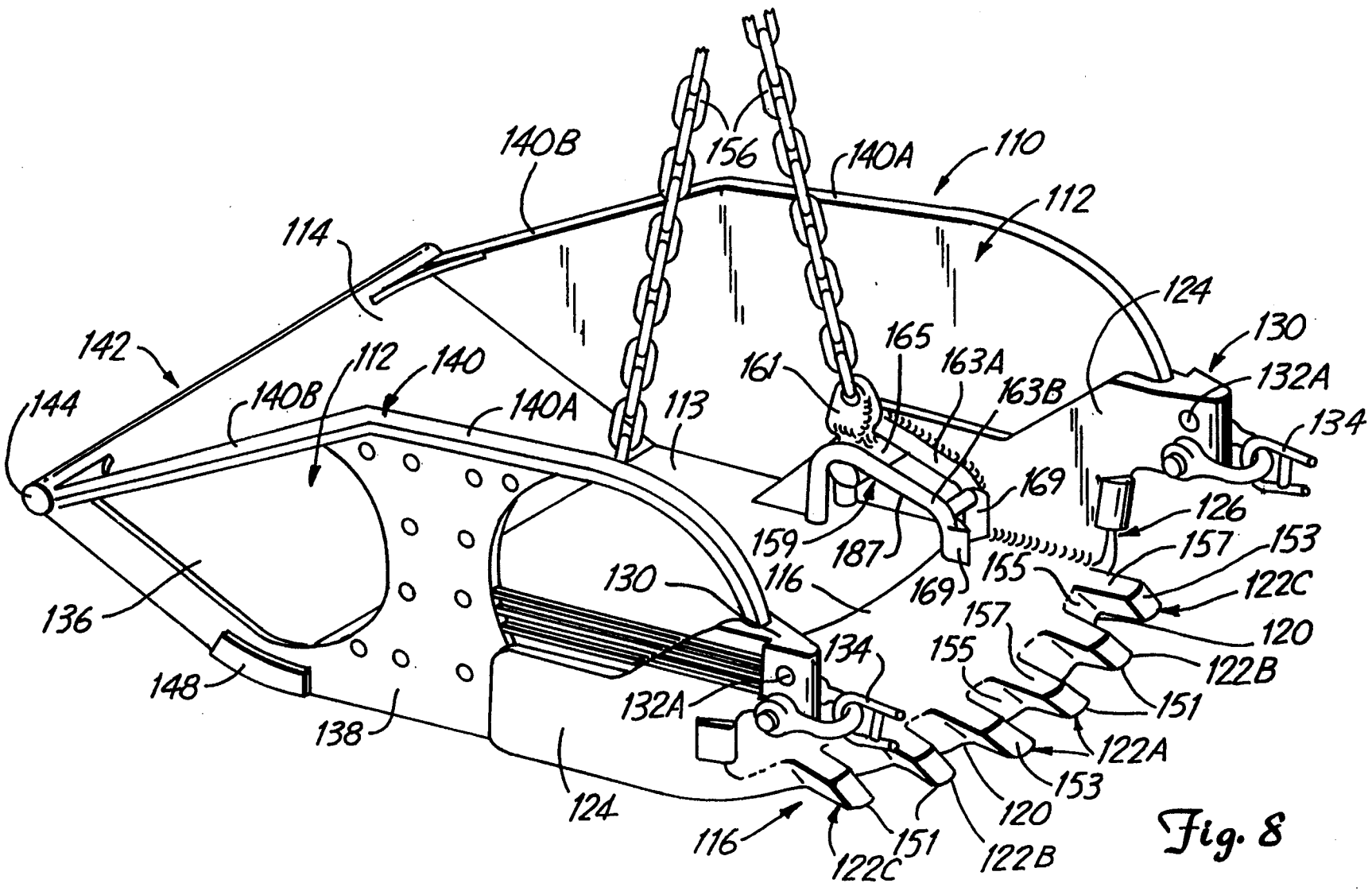
FIG. 8 is a perspective view taken of the modified dragline bucket of the present invention with slider trunnions and planar teeth.

As can be seen in FIG. 8, the forward part of the lip plate assembly 116 extends outwardly in the same plane as the bucket floor 113, and it is the downward slope cut of the excavating teeth which enhances the digging and filling of the bucket. The staggering of the teeth along the front curved edge 120 also enhances the digging into the earth and the filling of the bucket.

Shown in FIG. 8 is the bucket 110 being hoisted through the use of the pair of hoist chains, indicated generally at 156, with each chain having a "T" shaped pin 161 held in place on the bucket with suitable slider trunnions or supports 159. Slider trunnions are held in place on the floor 113 of the dragline bucket 110 and to the inside of heavy cheek plates 124. The slider trunnions 159 each have two longitudinal cylindrical rail members 163 inclined upwardly with respect to the floor 113 in rearward direction. The side parts 165 of the head of the T-shaped pin 161 are pulled tightly up against the inner radius 187 of the longitudinal rails 163 when the hoist chains 156 are taut. The sliding pin 161 pivots about the radius at the rear bend of the longitudinal rails 163 as the bucket 110 tilts.

The bucket 110, when filled and suspended from hoist chains 156 positioned at the rear of slider trunnions 159, creates a moment about the pins 161, causing the bucket 110 to tilt rearwardly under gravity. However, in the rear position, the pivot points of the head members 165 of pins 161 are close to the center of gravity, which reduces loads or forces on the draglines during the hoisting and swinging cycle of a full bucket which reduces tightlining of the hoist and draglines and reduces stresses to the boom. There is also less need to keep the hoist lines tight while the drag chains are loading the bucket, with the teeth digging into the ground. It can also be seen that the tension on the drag chains 134 at either one of the drag chain connection openings 132A or 132B will tend to provide a countering force or moment retaining the bucket in a position against the force of gravity.

The pivoting regions at the rear of each of the two longitudinal rails 163 on the slider trunnions 159 permit easy pivoting when the bucket is loaded. The forward end of each rail 163 bends down and is attached to the bucket floor 113. A dirt or rock deflector 169, which allows for smoother and fuller loading of the bucket 110 shields these forward ends. The deflectors divert dirt or rocks away from the rail by expanding triangularly around the rail.

Figure 9:
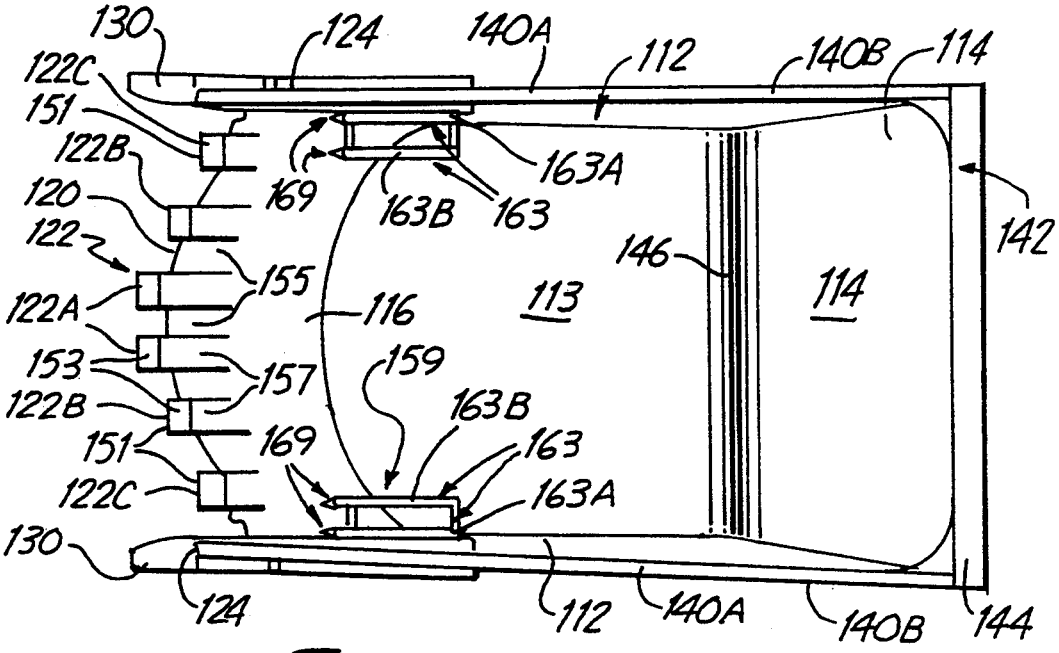
FIG. 9 is a top plan view of a modified dragline bucket with slider trunnions.
Figure 10:
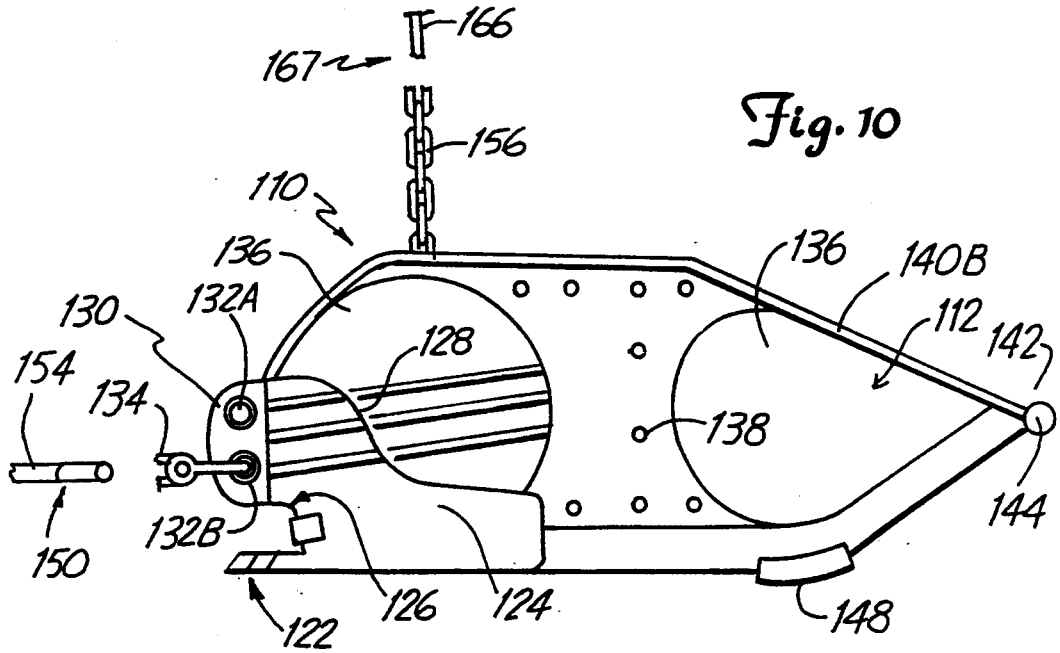
FIG. 10 is a side elevational view of a modified bucket with planar teeth.

FIG. 9 shows the slider trunnions 159 as they are mounted to the bucket floor 113. Also shown is the mounting of the outside rail 163A of each trunnion to the corresponding sidewall 112 of bucket 110 for strength and rigidity. FIG. 9 and FIG. 10 also show the excavating teeth 122 in relation to the plane of the bucket floor 113 as well as showing the sloped cut 153 on each of the teeth 122 which forms the bottom edge 151 on the teeth. The front curved edge at the outer end of the crevices or spaces 155 on the lip plate assembly 116 and the staggered teeth that generally follow a converse curve or contour creates a toothed cutting edge that enhances the digging of earth and filling of the bucket by decreasing the power and time needed to fill the bucket. Also, the need to drag or smooth the earth after excavation is eliminated and the force needed to fill the bucket is reduced by eliminating downwardly angled teeth that extend far below the bucket.

At the start of the hoist cycle, the hoist chains 156 via hoist cable 166, which together form hoist lines 167 (FIG. 10) are tightened by running the drum from the power unit 135 to tighten and reeve in the hoist cables 166. This puts a lifting force through the hoist lines 167 on the pins 161 to lift the bucket through the rails 163 of slider trunnions 159. Loaded bucket 110 is lifted while the draglines 150, which include the drag chains 134 and cable 154 and which operate as shown in FIG. 5, exert a holding force to the drag connections to offset gravitational moments to keep the bucket in a substantially level position as it is hoisted. The swing of the boom will be started as the bucket clears the excavation site.

Figure 11:
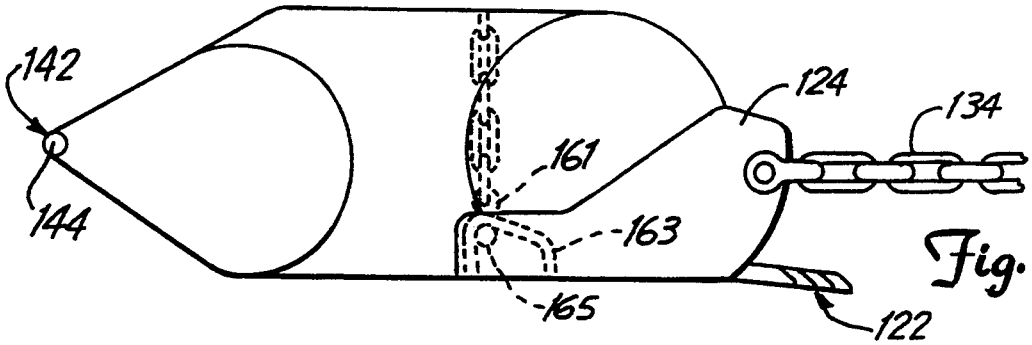
FIG. 11 is a view of the modified dragline bucket of the present invention during the hoisting operation.
Figure 12:
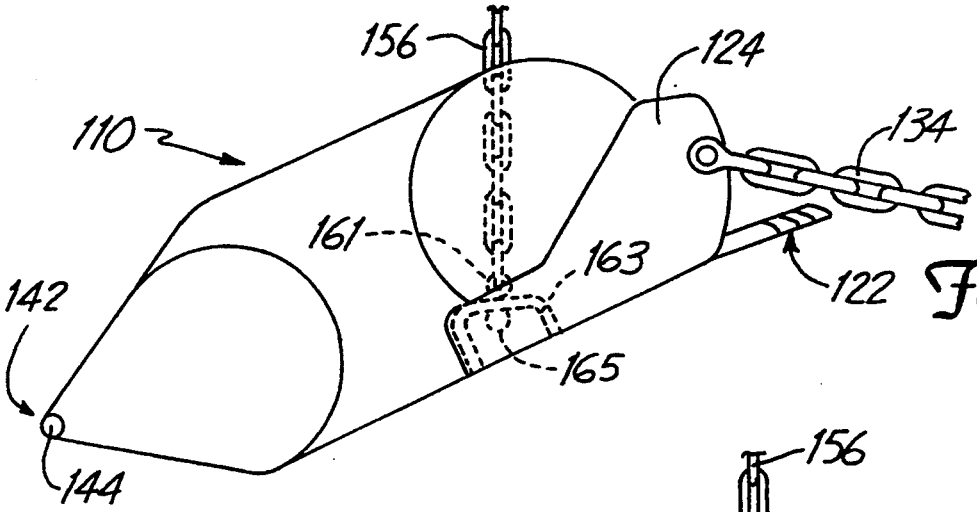
FIG. 12 is a view of the modified dragline bucket of the present invention when tension has been released on the drag chains to allow the bucket to begin pivoting.

Once the bucket is swung to a position over the dumping site, the draglines will be payed out of the drag drum under the control of the operator which will allow the bucket to pivot on the pinion 161 at the rear of the rails 163 and start to dump. FIG. 11 shows the bucket 110 when tension on the dragline 134 is sufficient to offset the gravitational moment. Thus, the pins 161 remain at the rear of the rails 163. FIG. 12 shows that as enough slack in the draglines 134 occurs as the tension of the draglines is decreased, the sliding pins 161 start to slide to position the pins at the forward ends of the rails 163 and the center of gravity goes farther forward for fast, full dumping. The bucket will tilt fully rearwardly and dump rearwardly as shown in FIG. 13, causing the material to flow out along the rear wall and out over the edge 142 of bucket 110.

Figure 13:
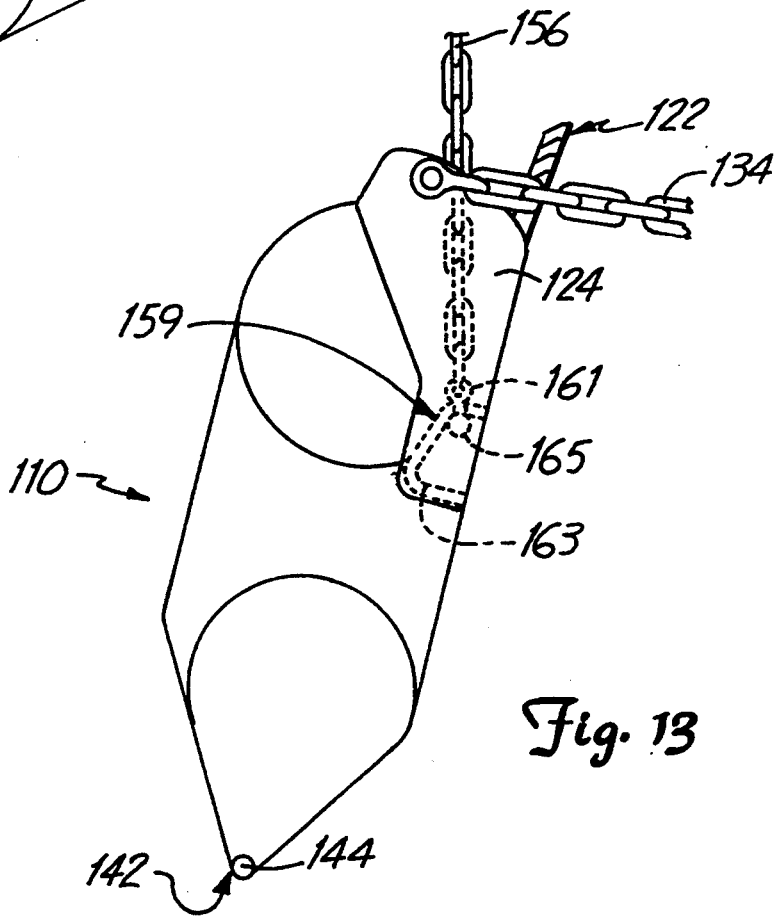
FIG. 13 is a view of the modified dragline bucket of the present invention being dumped.

As shown in FIG. 13, the hoist chains 156 are pivotally mounted through pins 161 at the hoist slider trunnions 159 near the forward end and closer to the floor of the dragline bucket and the outside longitudinal members mount to the inside face of the cheek plates on the sidewall 112. Paying out of the draglines allows the bucket to pivot on the slider trunnions 159 and eventually tip back and discharge the overburden in a direction away from the dragline power unit 35, with the inertia of the materials tending to carry it away from the power unit. This makes dumping possible at a greater height and a further distance away from the power unit than the front dump buckets when using the same length boom. The pins 161 are recocked into the rear pivots.

Thus, the overall dragline process starts with the step of filling a bucket 110 as is shown in FIG. 5 wherein the drag cables 154 and the drag chains 134 (which together form draglines 150 of the form shown in FIGS. 8–13) would be in tension to tilt the bucket 110 forward as the rear of the bucket touches the ground in its digging position, The hoist lines 167 which have cables 166 connected to house chains 156 are kept at a desired length to provide a proper angle to the teeth 122. The trunnion pins 161 are at the rear of the trunnions 163 during the loading of the bucket. The bucket 110 is then pulled by the draglines 150 to be filled to the desired level. As the bucket 110 starts its dumping cycle the trunnion pins 161 will shift forward on the trunnions 163 resulting in a swift and clean dumping process. The loaded bucket 110 can be hoisted nearly under the boom point due to the trunnions 159 position forward of the center of gravity. There is less tension needed from the draglines 150 to keep the loaded bucket 110 level during the hoisting cycle. These sliding trunnions reduce tightlining of the draglines 150 and hoistlines 167 during the hoisting of the loaded bucket 110 which reduces stress on the boom.

Figure 14:
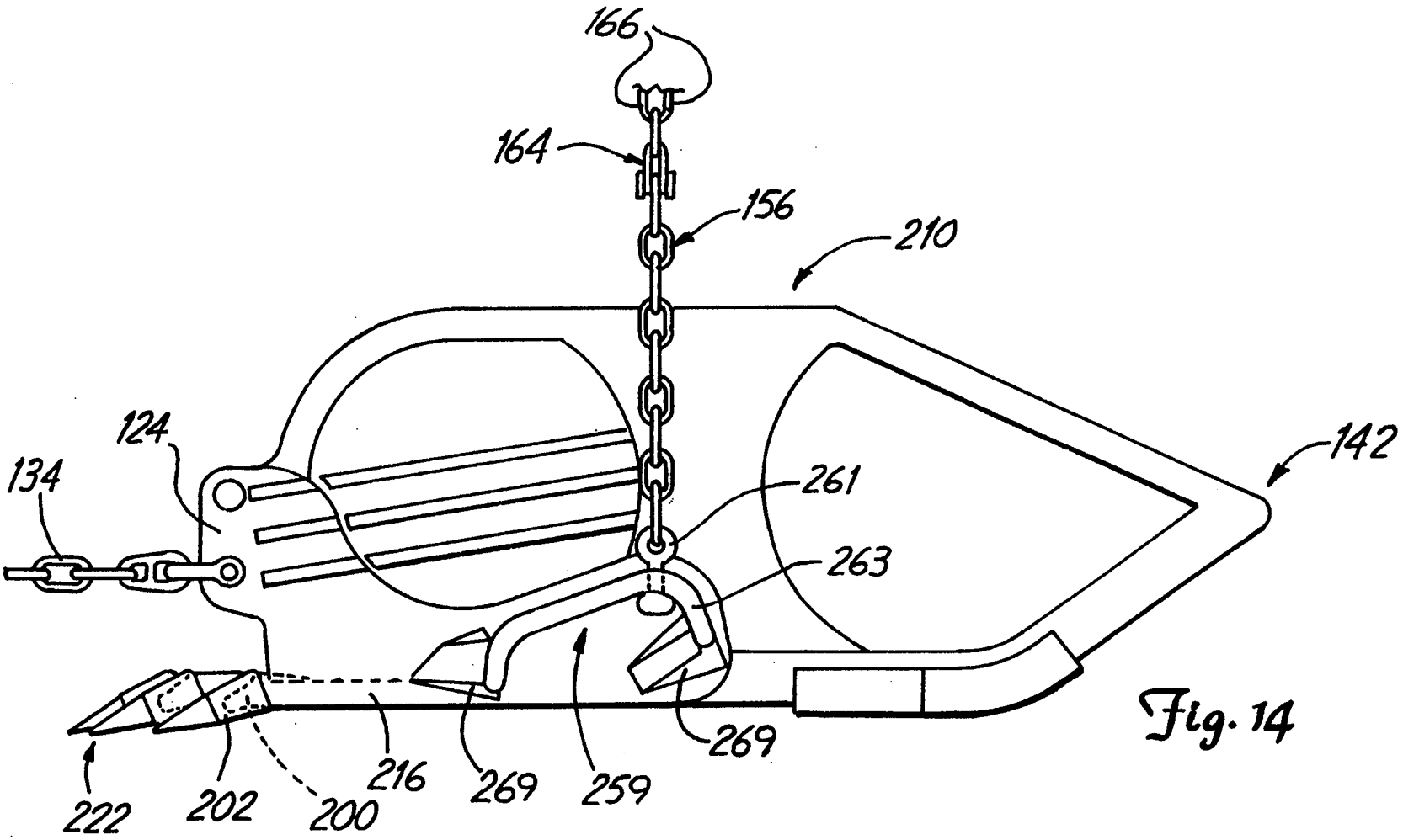
FIG. 14 is a side elevational view of the further modified dragline bucket with the slider trunnions outside the bucket.

Another preferred embodiment is shown in FIG. 14 with the slider trunnions on the outside of the bucket. The outside sliding trunnion 259 is attached to the floor 113 of the bucket. The sliding trunnion consists of two longitudinal cylindrical rail members 263 inclined upwardly with respect to the floor in a rearward direction with the inside rail member 263B being connected to the outside of the sidewall. A T-shaped pin 261 pivots about the inner radius of each of the longitudinal rails according to the tension on the hoist chains and dragline chains. The T-shaped pins pivot in two positions as previously explained. The modified bucket operates and is loaded in the same manner as the previously discussed embodiments, including having deflectors diverting dirt and rocks from the forward ends of the rails.

Figure 15:
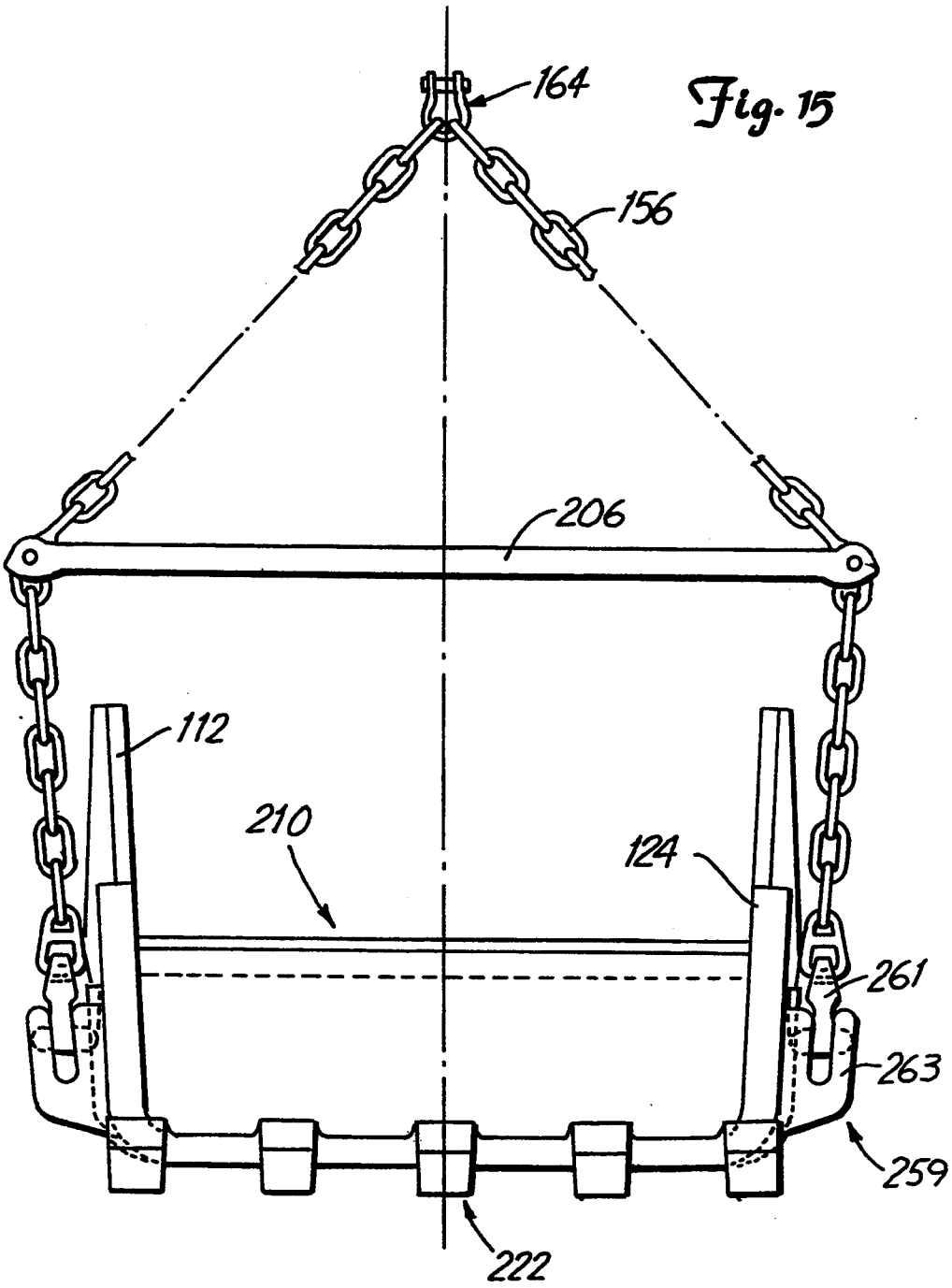
FIG. 15 is a front elevation view of the further modified dragline bucket.

FIG. 15 shows the bucket from the front with outside slider trunnions 259. The use of the outside trunnions requires a hoist line spreader bar 206 positioned in and attached to the hoist chains 156 above the bucket 210. This hoist line spreader bar 206 allows the trunnions to be placed outside the bucket by spreading the hoist chains 156 so that these chains clear the bucket sides and remain away from the bucket or load carried in it. The spreader bar further prevents contact between the hoist chains and the cheek plates since contact could damage the bucket. In this form of the invention, the T-shaped pins also slide forwardly for dumping and can be recocked to the rearward position for loading by use of the drag chains, or by letting the rear of the bucket strike the ground and then pivot forwardly.

Although the present invention has been described with reference to preferred embodiments, workers skilled in the art will recognize that changes may be made in form and detail without departing from the spirit and scope of the invention.

What is claimed is:

1. A dragline bucket comprising:

a floor, a pair of sidewalls extending upwardly from the floor, and a rear wall that slopes rearwardly and upwardly from the floor, the bucket having a forward end, including teeth for excavating material from the ground, said dragline bucket having a center of gravity between the rear wall and the forward end, the sidewalls tapering outwardly from the forward end of the bucket toward the rear wall and the sidewalls also tapering outwardly in an upward direction from a position where the sidewalls join the floor;

means for connecting hoist lines to each of said sidewalls between the forward end of the bucket and the center of gravity; and drag line attachment means positioned at forward edges of each of the sidewalls at a position spaced above the floor and above the means for connecting hoist lines to the sidewalls, the sidewalls having upper edges generally parallel to the floor and wherein said rear wall extends upwardly to a level between the level of the upper edges and the floor, and wherein the sidewalls taper downwardly and rearwardly to join the rear wall, the rear wall tapering upwardly and rearwardly from the floor at an angle of about 30° measured from the plane of the floor at an exterior of the rear wall.

2. The dragline bucket of claim 1 wherein the bucket has a front edge, the front edge having a generally rounded configuration, and excavator teeth attached to the front edge having forward protrusions that extend forwardly in center portions of the front edge a greater distance than adjacent the sidewalls of the bucket.

3. The dragline bucket of claim 2 wherein lower edges of the teeth protrude slightly below the plane of the bottom wall.

4. The dragline bucket of claim 1 wherein the forward end of the bucket has a heavy plate-like lip extending across the floor and forming a forward portion of the floor, and heavy cheek plates on opposite sides of the lip extending upwardly from the lip, the means for connecting hoist lines being mounted on the heavy cheek plates.

5. The dragline bucket of claim 4 wherein the means for connecting hoist lines comprise trunnions that are elongated in a longitudinal direction of the bucket, and slide members that slide along the trunnions to change an effective pivot axis position of the hoist lines relative to a center of gravity of the bucket.

6. A dragline bucket and control system comprising:

a bucket having a floor, a pair of sidewalls extending upwardly from the floor, and a rear wall that slopes rearwardly and upwardly from a junction with a rear edge of the floor, and having a front edge including excavator teeth, said bucket having a center of gravity, through which a reference plane passes;

hoist line means connected to each of said sidewalls for pivotal movement of the bucket about an axis generally normal to the sidewalls and positioned between the front edge of the bucket and the center of gravity to thereby result in rearward pivoting and rear dumping;

drag line means attached to front edges of each of the sidewalls at a position spaced above the floor, whereby when tension is applied to said drag line means, the applied forces will create a moment tending to resist rearward pivotal movement of said bucket when the bucket is supported directly on said hoist line means; and means to provide a force on said drag line means to control the pivotal position about the pivotal axis of the hoist line means solely through tension of the drag line means, said sidewalls having upper edges and wherein said rear wall extends to a level between the level of the upper edges and the floor, and said sidewalls taper downwardly and rearwardly from a region above the junction of the floor and rear wall to join the rear wall, the rear wall tapering upwardly and rearwardly from the rear edge of the floor at a gentle slope and having a top edge positioned at a level about midway between the plane of the floor and the upper edges of the sidewalls.

7. A dragline bucket having a floor, a pair of sidewalls extending upwardly from the floor, an a rear wall that slopes rearwardly and upwardly from the floor, the dragline bucket having a forward end and a rear end and a longitudinal direction between the front and rear, the dragline bucket having drag line attachment means positioned at the forward end and the dragline bucket having hoist line attachment means for connecting hoist lines to the dragline bucket with the hoist line attachment means comprising:

pin means for connecting the hoist lines to the dragline bucket;

trunnions fixedly mounted on the opposite sides of the bucket for receiving the pin means for connecting the hoist lines to the bucket, the trunnions each having two pin means pivots spaced in said longitudinal direction, both of the pin means pivots of each trunnion being between a center of gravity of the dragline bucket when loaded and the forward end of the bucket, the pin means of each trunnion pivoting in a rearward one of the pin means pivots during loading and hoisting movements of the bucket and the pin means moving to a forward pin means pivot during a dumping movement of the bucket.

8. The dragline bucket of claim 7 wherein each of the trunnions consists of two longitudinal rail members with first and second ends, said longitudinal rail members each having portions defining the pin means pivots.

9. The dragline bucket of claim 8 wherein each of the longitudinal members defines a rearward pin means pivot closer to the center of gravity of a loaded bucket than the forward pin means pivot.

10. The dragline bucket as specified in claim 8 wherein the longitudinal rail members slope downwardly from a rearward pin means pivot to the forward pin means pivot relative to the bucket floor.

11. The dragline bucket as claimed in claim 10 wherein each of the pin means is attached to a hoist line and has a portion which fits under the longitudinal rails, and another portion which extends between the rails, and wherein each pin means pivots on a downwardly sloping portion of the rail member at a location controlled by the position of the hoist line and the dragline, where varying tension on the draglines causes pivoting.

12. The dragline bucket of claim 11 wherein the pin means is T-shaped with a head of the T-shape sliding under the rails.

* * * * *